United States Patent [19]

Surkamp et al.

[11] 4,362,188

[45] Dec. 7, 1982

[54] ROTARY DOBBY

[75] Inventors: Paul Surkamp, Kempen-St. Hubert; Josef Brock, Viersen, both of Fed. Rep. of Germany

[73] Assignee: Maschinenfabrik Carl Zangs Aktiengesellschaft, Krefeld, Fed. Rep. of Germany

[21] Appl. No.: 221,465

[22] Filed: Dec. 30, 1980

[30] Foreign Application Priority Data

Jan. 16, 1980 [DE] Fed. Rep. of Germany ..... 3001310

[51] Int. Cl.[3] ..... D03C 1/12

[52] U.S. Cl. ..... 139/76

[58] Field of Search ..... 139/66 R, 76, 78

[56] References Cited

U.S. PATENT DOCUMENTS 3,207,186 9/1965 Hoenig ..... 139/66 R 4,315,530 2/1982 Brock et al. ..... 139/76

FOREIGN PATENT DOCUMENTS 1405184 5/1965 France ..... 139/66 R 320577 1/1972 U.S.S.R. ..... 139/66 R

*Primary Examiner*—Henry Jaudon

*Attorney, Agent, or Firm*—Martin A. Farber

[57] ABSTRACT

The invention relates to a rotary dobby having a wedge coupling between a drive shaft and an eccentric device for the harness motion, in which the wedge is displaceably supported in a radially extending recess in an eccentric disk arranged in a crank arm and can be coupled and uncoupled in accordance with a pattern in an axially extending groove of the drive shaft at two diametrically opposite coupling locations by a shift rod which is controllable in accordance with a pattern and engages by a coupling member into a groove of the wedge which is open in axial direction of the drive shaft. In order to assure a dependable coupling and uncoupling at high speeds of revolution, the wedge is locked against displacement in its coupled position by a spring-biased locking pawl on the eccentric disk and the locking pawl is displaceable by the coupling member of the shift rod into a position which permits the uncoupling of the wedge.

8 Claims, 12 Drawing Figures

IV
IV
3
4
5
6
7
8
9
10
10(11)
12
13
14
15
16
17
18
19
20
21
22
23
24
25
26
27
28

ROTARY DOBBY

The present invention relates to a rotary dobby having a wedge coupling between a drive shaft and an eccentric device for the harness motion, in which the wedge is displaceably supported in a radially extending recess in an eccentric disk arranged in a crank arm and can be coupled and uncoupled in accordance with a pattern in an axially extending groove of the drive shaft at two diametrically opposite coupling points by a shift rod which is controllable in accordance with a pattern and engages by a coupling member into a groove of the wedge which is open in axial direction of the drive shaft, and to a control for said rotary dobby.

From West German AS Nos. 2 036 643 and 2 036 644 a rotary dobby having a wedge coupling is known in which the wedge is guided in axial and radial direction on a rim controlled in accordance with the pattern and in addition in radial direction on approximately semicircular guide rails which are spring-mounted on the crankshaft for the harness motion. In this known wedge coupling, the guide rails are moved back and forth with the crank rod to which they are fastened. As a result of the relative movement of the guide rails with respect to the wedge which is inherent in this design, wear can be noted on the slide surfaces. Furthermore, there is the danger that the wedge will, in case of improper shiftings, come beneath the guide rail and become jammed.

In view of the earlier patent application pursuant to West German AS No. 28 41 279, a rotary dobby having a wedge coupling of the above described type in which the wedge is guided by a ring which is arranged concentric to the drive shaft and has two radially extending grooves lying in the coupling regions is part of the prior art. In that case the ring is fixed in its operating position by a disconnectable lock. The ring for guiding and locking the wedge is a machine part which the rotary dobby of the present invention can dispense with.

From both West German AS No. 2 036 643 and West German AS No. 2 036 644 there is also known a control for a wedge which operates from a needle mechanism by means of a pivotably mounted shift arm which engages with a closed rim into a groove of the wedge. This control has the disadvantage that upon replacement of the closed rim, disassembly of the drive shaft is necessary. This is a time-consuming job which results in a long period of shut-down of the loom.

Finally, from West German OS No. 1 535 207 there is also known a lifter control for a dobby in which the lifters are controlled by lifter carriers, the latter being suspended from control levers and in which every two pressing needles are connected via a balance lever with a control lever. With this known lifter control the result is obtained that the control lever and thus the lifter carrier and the lifter (which lifter is suspended from it) do not execute two successive movements when, upon change of lifters, one needle passes into the working position and the other needle into the position of rest, but rather they remain at rest since the opposing movements of the two pressing needles counteract each other. In this way the time which is necessary for the control of the lifters can be reduced considerably. This known lifter control is employed in the present invention.

Based thereon, the object of the invention is to provide a rotary dobby having a wedge coupling and a control adapted thereto which, even in case of high speeds of revolution, assures a dependable coupling and uncoupling of the wedge and cannot be damaged in case of erroneous shiftings.

This object is aided in its solution in general in the manner that the wedge, in its coupled position, is locked against displacement by a resiliently mounted locking pawl on the eccentric disk and that the locking pawl is displaceable by the coupling member of the shift rod into a position which permits the uncoupling of the wedge.

In a first practical embodiment, the locking pawl can be arranged in the wedge itself. For this purpose, the wedge is provided at the end thereof facing the eccentric disk with an axially extending opening in which the locking pawl is mounted for swinging against the action of a spring. The locking pawl is swingably mounted at one end of its transverse arm on a pin which is fastened in the opening of the wedge, while the other end of the transverse arm extends into the groove of the wedge and thus into the path of movement of the coupling member of the shift rod. In order to hold the wedge in its coupled position, a lengthwise arm of the locking pawl extends out of the opening of the wedge and cooperates with a locking arm in the recess of the eccentric disk.

In a second practical embodiment, the locking pawl can be arranged outside the wedge on the eccentric disk. For this purpose, the wedge can be provided with lateral extensions on the end thereof facing the drive shaft while one a locking pawl swingable against the action of a compression spring is arranged on each side of the eccentric disk, said pawls cooperating with the extensions to hold the wedge in its coupled condition. In order for both locking pawls to be able to be actuated by the coupling member of the shift rod, they are provided with control pins which are arranged eccentrically to their pivot axes and extend into the path of movement of said coupling member.

A rotary dobby developed in accordance with the invention has the advantage, in both of its practical embodiments, that no special structural elements are required any longer for guiding the wedge on its path, in particular the known spring-mounted approximately semicircular guide rails and the closed rim used for the control or the guide ring known from the prior art. These structural parts for guiding and control of the wedge upon its revolution are namely parts which are subject to wear and the maintenance and possible replacement of which are difficult since they surround the drive shaft. It has been found that by this invention the coupled wedge is dependably held in its coupled position by the locking pawl during its revolution since there is provided a coupling which is form-locked (locked by the shapes of the cooperating parts) in this position and cannot open without external action. This form-lock between the wedge and eccentric disk in the coupled position is actuated at the coupling locations of the wedge by the coupling member of the shift rod which is moved in accordance with the pattern. In its uncoupled position, the wedge is then held fast between two spring-biased stop slides arranged on each crank arm at each coupling place.

In accordance with another feature of the invention, in a control for the rotary dobby of the present type the shift rods for the coupling members can be developed as double armed levers and be connected with each other by a control rod which is pushed back under spring biasing into its starting position, the control rod being mounted for displacement in an axial direction and cooperating via a balance lever with a known needle mechanism.

A control developed in accordance with the invention has the advantage that both upon intermittent and upon continuous operation, high speeds of the loom can be obtained. Furthermore a control developed in accordance with the invention is characterized by the fact that it makes use of the advantages of the known principle of design of the lifter control with a balance lever for control of a wedge coupling and cannot be damaged in case of erroneous shiftings.

With the above and other objects and advantages in view, the present invention will become more clearly understood in connection with the detailed description of a preferred embodiment, when considered with the accompanying drawings, of which:

Figure 1:
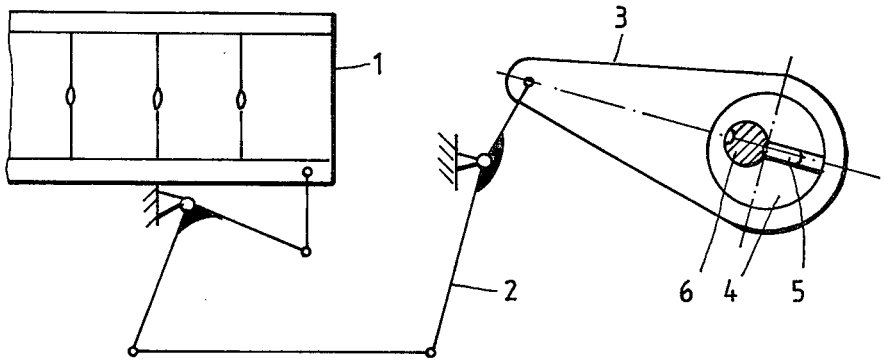
FIG. 1 is the diagram of a harness drive in the bottom shed position.
Figure 2:
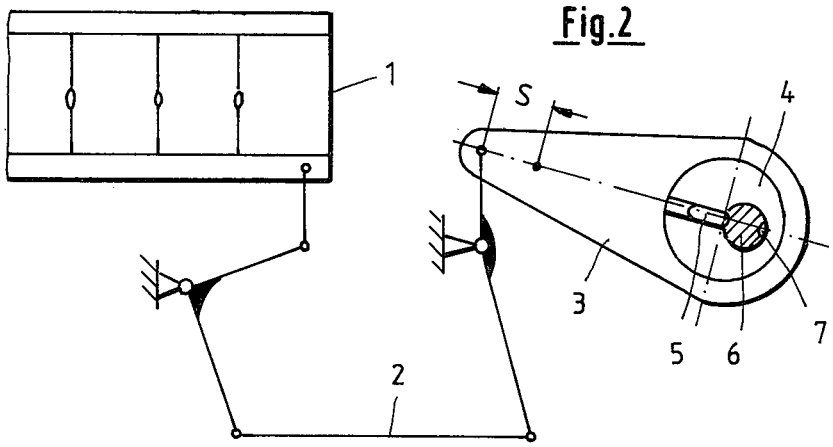
FIG. 2 is a diagram of a harness drive in the top shed position.

A harness 1 is moved from the bottom-shed position shown in FIG. 1 into the top-shed position shown in FIG. 2 or vice versa via a rod system 2 by a crank arm 3 which is mounted on an eccentric disk 4. For this purpose, the eccentric disk 4 can be coupled, by means of a radially displaceable wedge 5, with a drive shaft 6 which has two diametrically opposite axially extending grooves 7 for the wedge 5 to engage therein from time to time. The eccentric disk 4 when coupled by the wedge 5 with the drive shaft 6 moves the crank arm 3 upon half a revolution by a distance s from the bottom-shed position into the top-shed position or vice versa.

The wedge 5 is radially displaceably mounted in a radial recess in the disk 4 and is formed with a groove 8 open in axial direction into which there engages a coupling member 9 when the wedge 5 is at or arrives at a coupling location, i.e. at the coupling members 9. One coupling member 9 is fastened to each of the ends of two shift rods 10 and 11, the shift rods 10 and 11 being formed as double-armed levers which lie opposite each other and can be controlled in accordance with a pattern. The inlets and outlets of the groove 8 in the wedge 5 are provided with oblique surfaces 12 while the ends of the coupling members 9 are provided with curved surfaces 13 in order to assure undisturbed movement on and off of the wedge 5.

On its rear each wedge 5 is provided with an extension 14 which engages in a radially extending recess 15 of the eccentric disk 4. After the arrival of a coupled wedge 5 into the coupling region the wedge 5 is pulled by the coupling member 9 out of the groove 7 of the drive shaft 4 and thus uncoupled therefrom. The coupling of the wedge 5 into the groove 7 of the drive shaft 6 is effected by a corresponding reverse stroke of the coupling member 9.

The wedge 5 is fixed between two stop slides 16 and 17 in its uncoupled position when it has been displaced into this position by the coupling member 9. Each stop slide 16 and 17 is arranged countersunk in a recess in the crank arm 3 and has an extension formed with a blind hole 18 in which a compression spring 19 is mounted abutting against an end of the recess in the crank arm 3 and biasing the corresponding stop slides. The direction of movement of the two stop slides 16 and 17 forms an angle of about 25° with the direction of coupling of the wedge 5. On their face side which extends out of the surface of the crank arm 3, the stop slides 16 and 17 have slide-on surfaces 20 which form an angle of about 100° with the direction of coupling of the wedge 5. The directions of movement of the two stop slides 16 and 17 and the direction of their slide-on surfaces 20 are so cooperatively formed and arranged with respect to each other with respect to the direction of coupling of the wedge 5 that both during the forward and rearward direction of rotation of the drive shaft 6, an easy, uncomplicated uncoupling and locking of the wedge 5 is assured.

In the embodiment shown in FIGS. 3 to 6 the wedge 5 is provided in its upper half, approximately in the central plane, with an opening 21 within which a locking pawl 22 of T-shape, as seen in cross section, is pivotally supported on a pin 23 mounted on the wedge. A spring 25 is connected to and between a cross arm 24 of the locking pawl 22 and the wedge 5. A lengthwise arm 26 of the locking pawl 22 cooperates with a locking arm 27 in the recess 15 of the eccentric disk 4.

In the coupled position shown in FIG. 4, the lengthwise arm 26 of the locking pawl 22 is pulled by the spring 25 against a front wall 28 of the wedge 5 and thus lies below the locking arm 27 so that axial displacement of the wedge 5 radially outwardly into the uncoupled position is not possible. In this coupled blocked position there is a form-locked connection between the wedge 5 and the eccentric disk 4 so that the wedge 5 cannot uncouple itself from the groove 7 and the drive shaft 6 during its revolution.

Figures 3, 4, 5, 6:
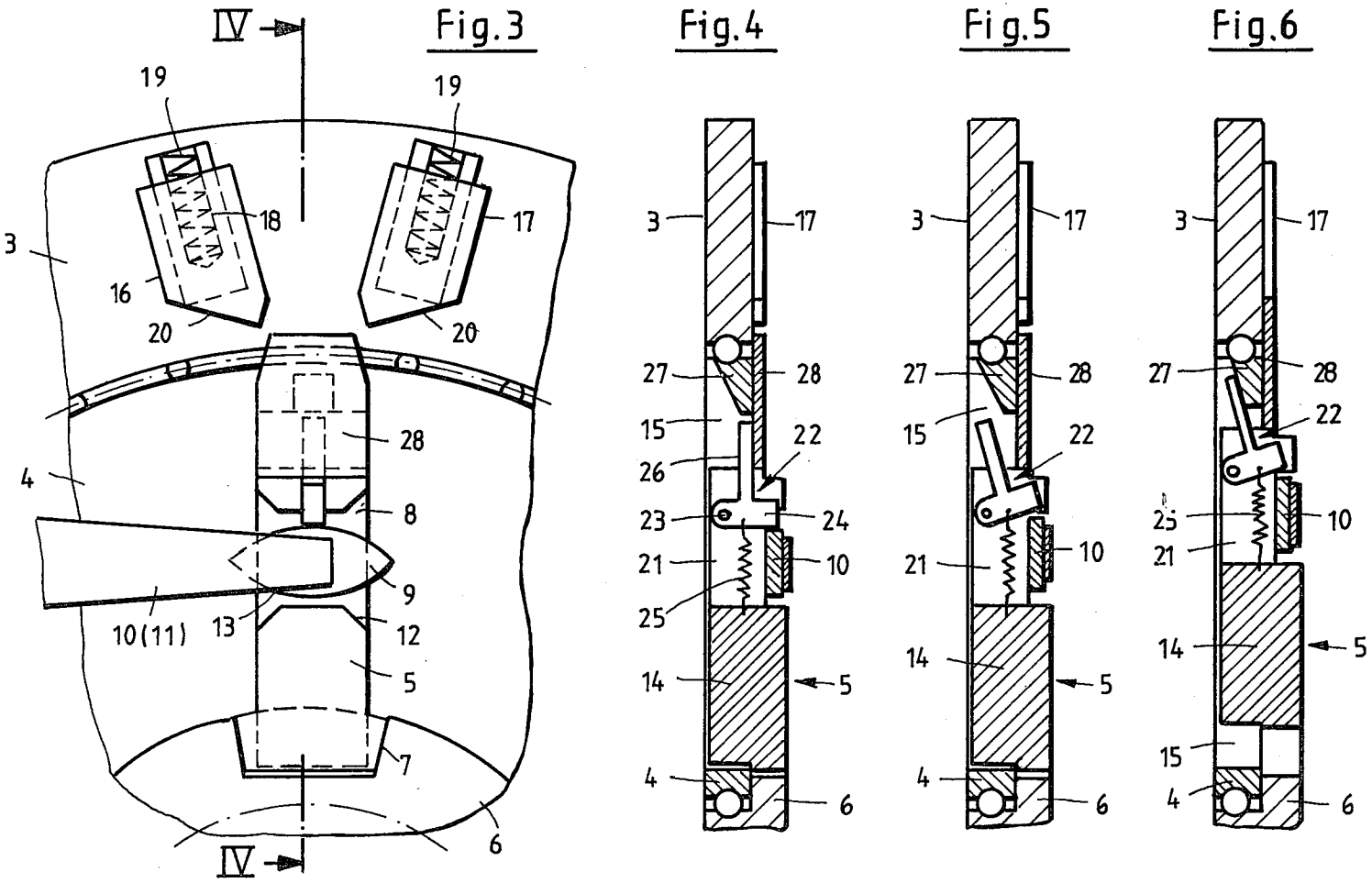
FIG. 3 shows a first embodiment of a wedge coupling with a couple wedge and a locking pawl arranged in the wedge, seen in side view and partially broken away.
FIG. 4 shows the same coupling in section along the line IV—IV of FIG. 3.
FIG. 5 shows the same wedge coupling of FIGS. 3 and 4 with the locking pawl swung out of its locking position, also seen in the same sectional view as FIG. 4.
FIG. 6 shows the same wedge coupling of FIGS. 3 to 5 with the wedge uncoupled, also seen in the same sectional view as FIG. 4.

When the wedge 5 is at a coupling location (i.e. arrives at the position of a coupling member a) the locking pawl 22 can be swung by the coupling member 9 (also constituting a switching member) into the unlocked position shown in FIG. 5. In this position of the locking pawl 22 it is then possible completely to uncouple the wedge 5 from the groove 7 in the drive shaft 6, since the pawl 22 no longer is under the blocking edge of the locking arm 27, as has been shown in FIG. 6.

The unlocking of the locking pawl 22 takes place at the start of a control movement of the coupling member 9. The locking of the locking pawl 22 takes place automatically under the biasing action of the tension spring 25 as soon as the shift member 9 has completely coupled the wedge 5.

Figure 8:
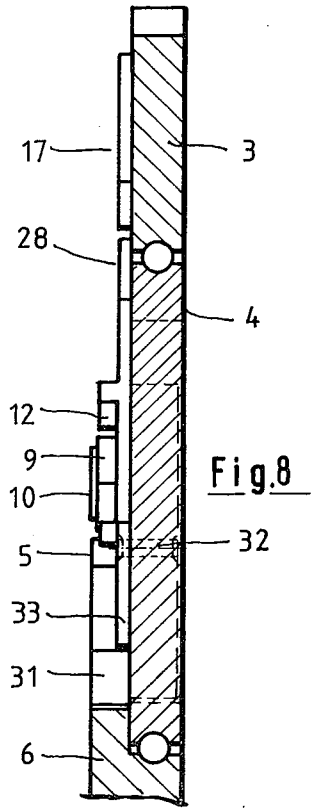
FIG. 8 shows the same wedge coupling in section along the line VIII—VIII of FIG. 7.
Figure 7:
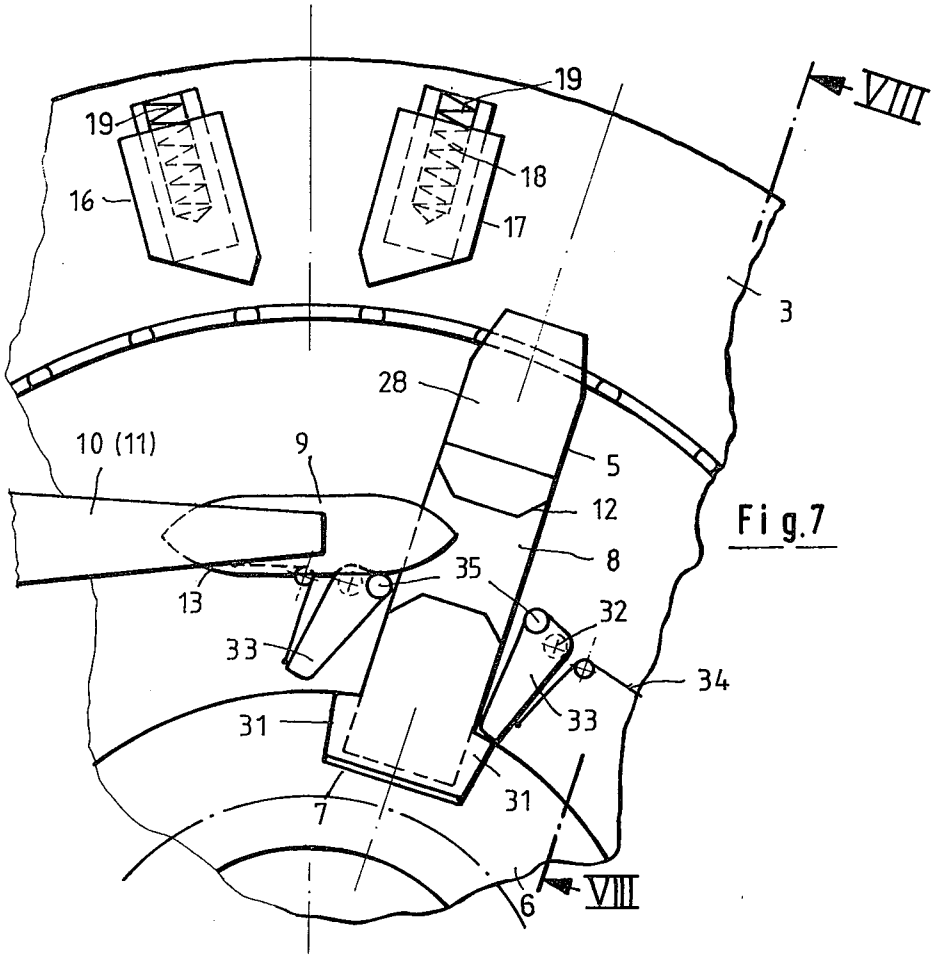
FIG. 7 shows a second embodiment of a wedge coupling with wedge coupled and, alongside of it, locking pawls swingably pivoted on an eccentric disk, seen in side view and partially broken away.

In the embodiment shown in FIGS. 7 and 8 the wedge 5 is provided, at the end thereof facing the drive shaft 6, with lateral extensions 31 which cooperate with locking pawls 33 mounted on pins 32 on the eccentric disk 4 on both sides of the wedge 5. The two locking pawls 33 are pressed toward the wedge 5 by compression springs 34 into their locked position and can be pivoted into the unlocked position by the coupling member 9 engaging control pins 35 on the pawls arranged eccentrically to the pins 32 of said pawls.

From FIG. 7 it can be seen that the locking pawl 33 which lies forwardly in the direction of movement (counterclockwise in FIG. 7) of the wedge 5 has already come against the coupling member 9 and therefore is pivoted into an unlocked position. When the wedge 5 moves completely into the coupling place, the other locking pawl 33 therefore also is moved (by further counterclockwise movement in FIG. 7) into its unlocked position by engagement of the coupling member 9 against the pin 35 of the pawl, so that the wedge 5 can be uncoupled.

The control shown in FIGS. 9 to 12 for a wedge coupling developed in accordance with the invention is very simple in its construction. The two shift rods 10 and 11 are pivotally mounted on fixed shafts 41, 42 and connected at their outer end via plain bearings 43 with a control rod 44 which, in its turn, is connected with a balance lever 45. On the balance lever 45 there are pivoted two lifters 46 which are connected with sensing needles 47 which scan a paper card—not shown—moved by a card cylinder 48. A hole in the paper card means that the sensing needles 47 drop-in and the lifters 46 come into the path of movement of blades 49.

The control rod 44 is pulled into its starting position by a compression spring 50 which rests against a stationary abutment 51 and a projection 52. On both sides of the plain bearings 43 for the two shift rods 10 and 11 there are also provided on the control rod 44 projections 53 to 56 with compression springs 57 and 58 connected therebetween in order to transmit the result of the sensing from the paper card to the coupling device for the wedge 5. The balance lever 45 cooperates with two stationary abutments 59 and 60.

Figure 9:
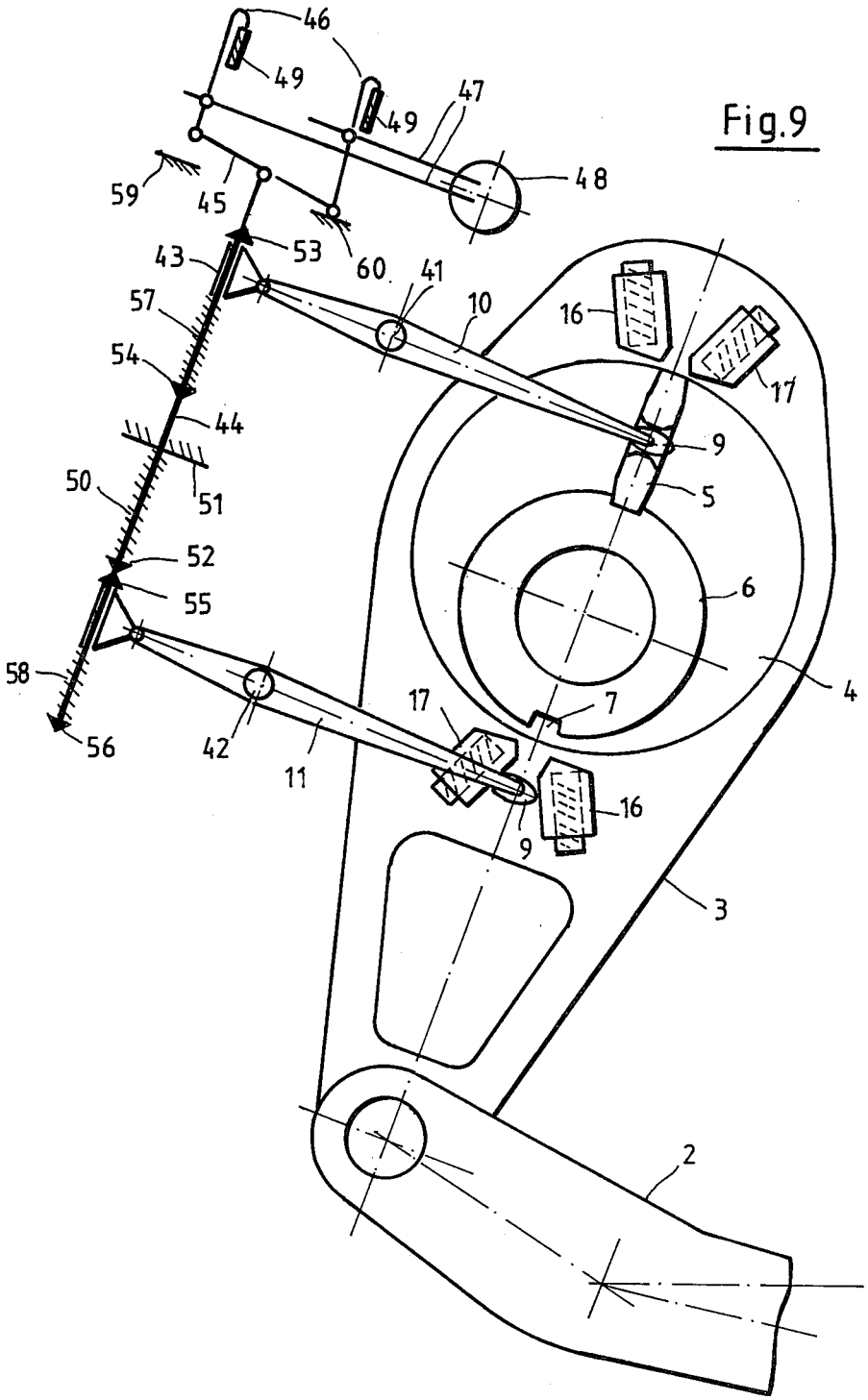
FIGS. 9 to 12 are diagrammatic views of a control for the wedge coupling for moving the harness from the bottom shed into the top shed or vice versa and for holding the harness in the bottom shed or in the top shed, seen in side view.

The control shown in FIGS. 9 to 12 operates as follows:

In the bottom-shed position shown in FIG. 9, the sensing needles 47 have found a hole in the paper card so that the lifters 46 have lifted the balance lever 45 from its abutment 59 and in this way have pivoted the shift rod 10 in such a manner that the wedge 5 has been coupled into the drive shaft 6. The corresponding harness is thereupon moved out of the bottom-shed position into the top-shed position since the eccentric disc 4 is now rotatably coupled with the drive shaft 6.

Figure 10:
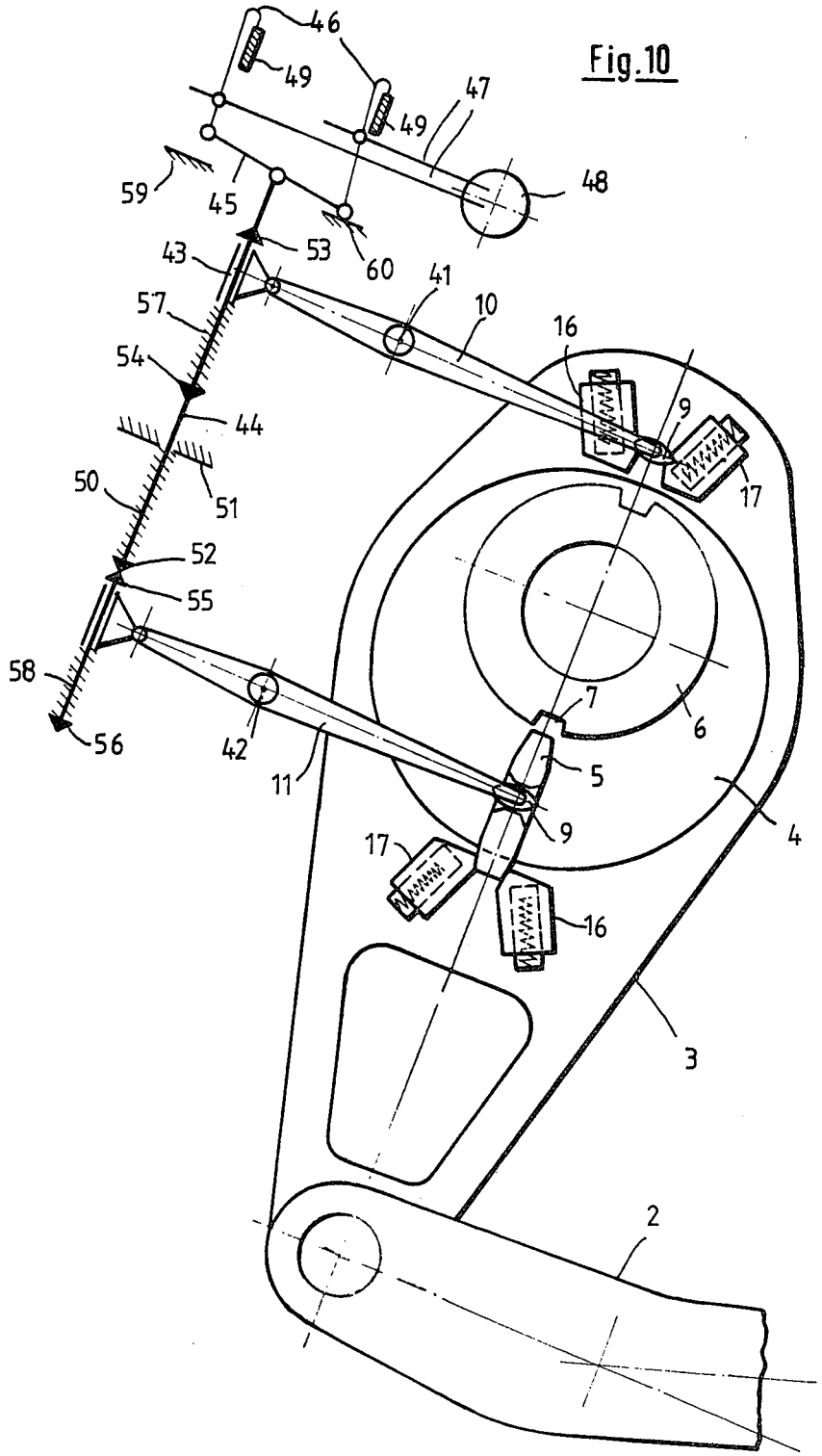

In the top-shed position shown in FIG. 10, a hole in the paper card has the result that the wedge 5 is uncoupled and forced by the shift rod 11 into its stopped position held fixed by the stop slides 16 and 17. The corresponding harness then remains in the top shed since the eccentric disc 4 is held uncoupled from the drive shaft 6.

Figure 11:
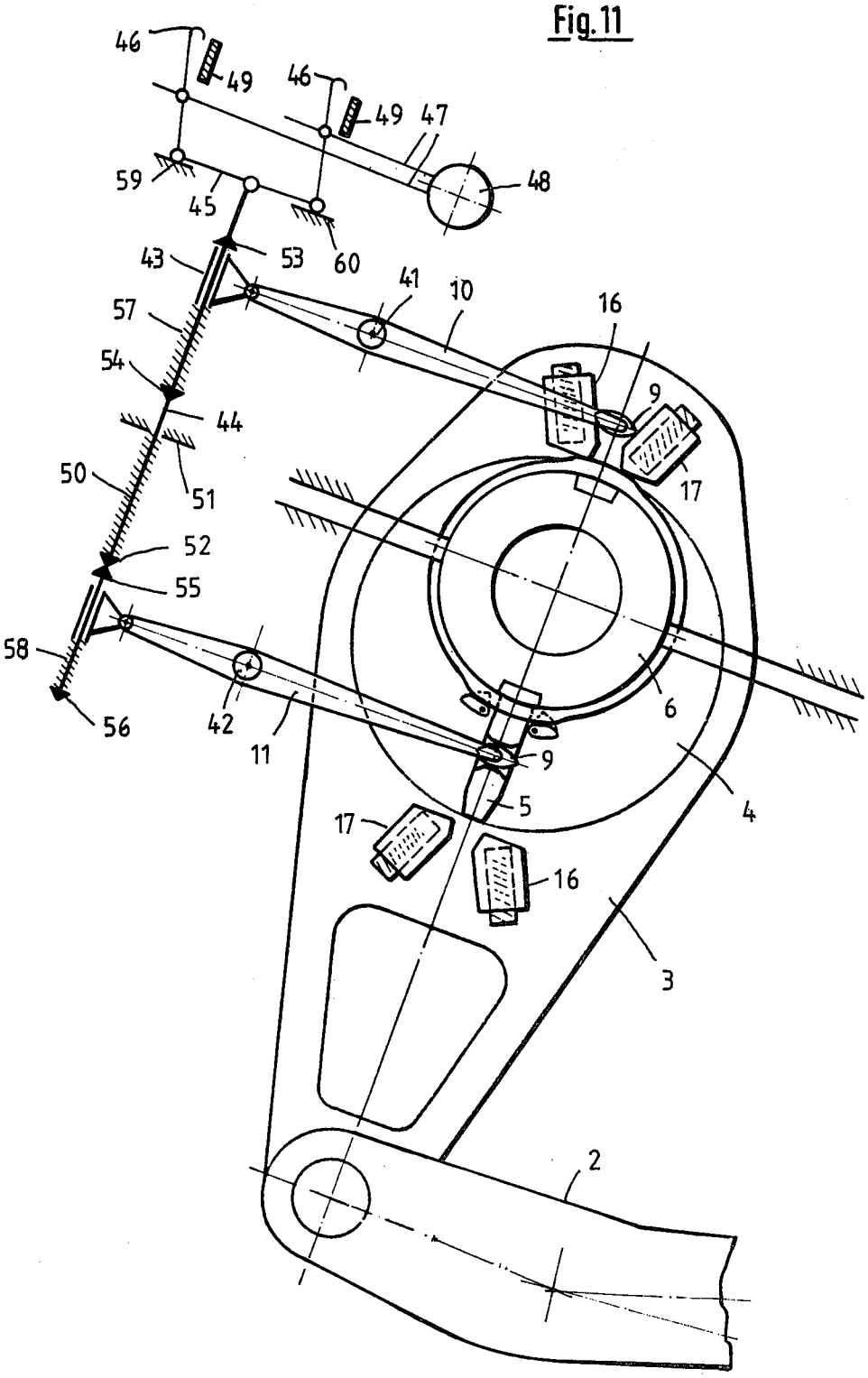

In the top shed position shown in FIG. 11, the sensing needles 47 have not found any hole in the paper card. The two lifters 46 remain outside the region of motion of the blades 49 so that the balance lever 45 rests on the abutments 59 and 60, whereby the shift rod 11 again couples the wedge 5 into the drive shaft 6. The corresponding harness is then moved from the top shed into the bottom shed since the eccentric disc 4 is now rotatably coupled with the drive shaft 6.

Figure 12:
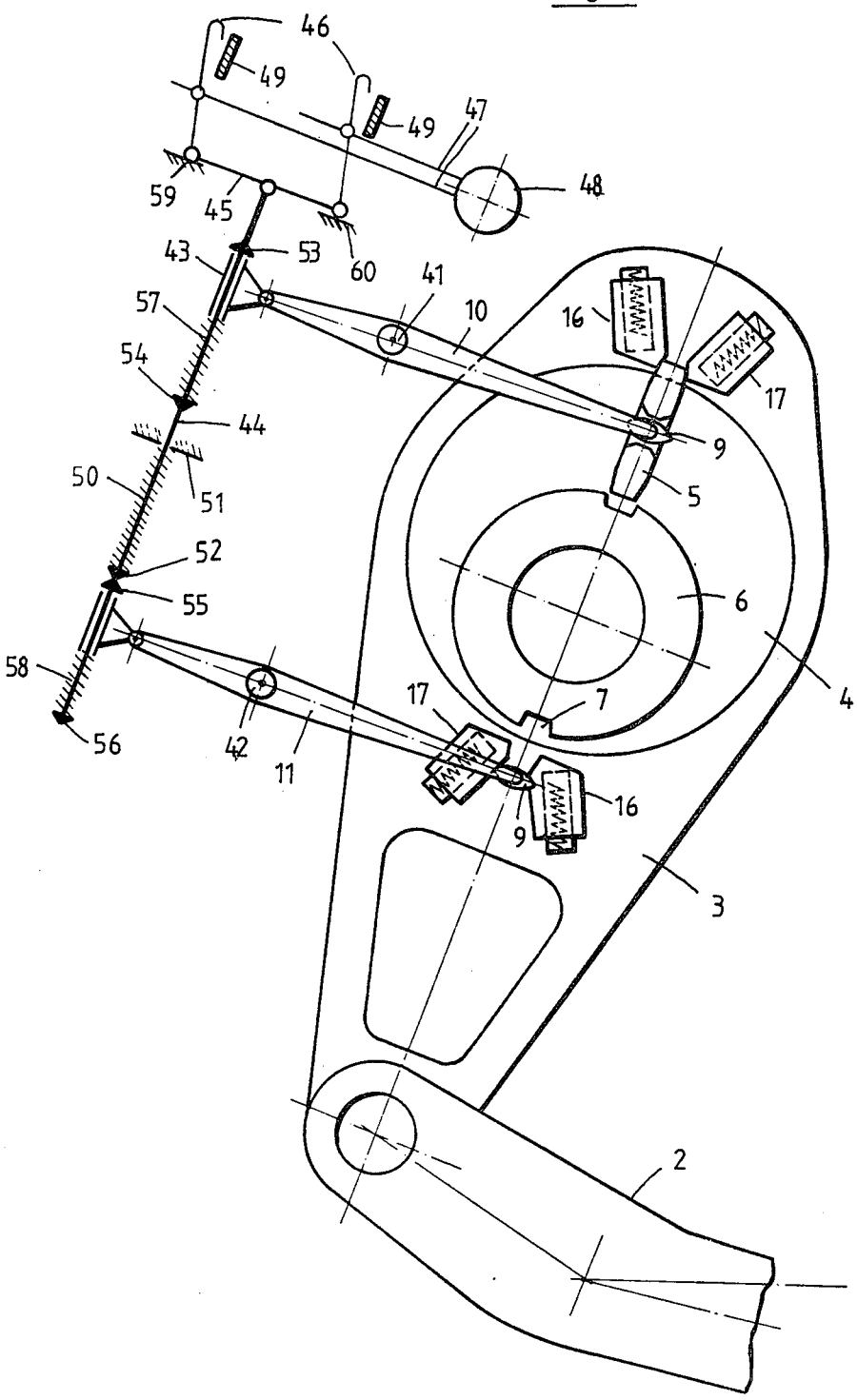

In the bottom-shed position shown in FIG. 12, the two sensing needles 47 have again not found any hole in the paper card so that the control remains in the position previously described and therefore the wedge 5 is uncoupled by means of the the shift rod 10 and pressed into its stopped position held fixed by the stop slides 16, 17. The corresponding harness remains in the bottom shed upon the following operating cycle since the eccentric disk 4 is held uncoupled from the drive shaft 6.

We claim:

1. In a rotary dobby having a wedge coupling between a drive shaft and an eccentric device for a harness movement, the wedge being displaceably mounted in a radially extending recess in an eccentric disc mounted in a crank arm and couplable and uncouplable in accordance with a pattern in an axially extending groove of the drive shaft at two diametrically opposite coupling locations by a shift rod which is controlable in accordance with the pattern and engages with a coupling member of the shift rod into a groove of the wedge which is open in an axial direction of the drive shaft, the improvement comprising a spring-biased locking pawl means for locking the wedge in a coupled position thereof on the eccentric disc against displacement, said locking pawl means for being displaceable with the coupling member of the shift rod into a position which permits uncoupling of the wedge.

2. The rotary dobby according to claim 1, wherein the wedge is formed on an end thereof facing the eccentric disc with an axially extending opening, said locking pawl means is pivotally mounted in said opening, spring means for pivotally biasing said locking pawl means.

3. The rotary dobby according to claim 2, wherein said locking pawl has a cross arm, pin means for pivotally mounting said locking pawl means to the wedge on one end of said cross arm in said opening of the wedge, another end of said cross arm extends into the groove of the wedge and into a path of movement of the coupling member of the shift rod.

4. The rotary dobby according to claim 2 or 3, wherein the eccentric disc is formed with a recess with a locking arm therein, said locking pawl means has a lengthwise arm extending out of said opening of the wedge adjacent to and operatively cooperatingly with said locking arm.

5. The rotary dobby according to claim 4, wherein said locking arm only partially closes the recess of the eccentric disc in which it is located.

6. The rotary dobby according to claim 1, wherein the wedge has lateral extensions on an end thereof adjacent the drive shaft, said locking pawl means comprises locking pawls pivotally mounted on the eccentric disc on both sides of the wedge, respectively, compression spring means for pivotally biasing said locking pawls, respectively, such that said locking pawls operatively cooperate with said extensions, respectively.

7. The rotary dobby according to claim 6, wherein said locking pawls have pivot pins, respectively, mounted on said eccentric disc, and have control pins, respectively, the latter extending into a path of movement of the coupling member of the shift rod and arranged eccentrically to said pivot pins of said locking pawls, respectively.

8. The rotary dobby according to claim 1, further comprising two spring-biased stop slide means for engaging therebetween a radially outer end of the wedge in the uncoupled position of the latter are mounted on the crank arm at each coupling location.

* * * * *